United States Patent [19]

Reinschütz

[11] 4,313,689

[45] Feb. 2, 1982

[54] SET OF PAVING ELEMENTS FOR PRODUCTION OF PAVING AND METHOD OF USING THE SAME

[76] Inventor: Hans Reinschütz, Geigersbergstrasse 2, 7500 Karlsruhe 41, Fed. Rep. of Germany

[21] Appl. No.: 828,094

[22] Filed: Aug. 26, 1977

[30] Foreign Application Priority Data

Sep. 4, 1976 [DE] Fed. Rep. of Germany ..... 7627698

[51] Int. Cl.[3] ..... E01C 5/00

[52] U.S. Cl. ..... 404/73; 52/608; 404/41

[58] Field of Search ..... 404/41, 37, 42, 46, 404/40, 34, 39; 52/596, 604, 608

[56] References Cited

U.S. PATENT DOCUMENTS

| | | | |
|---|---|---|---|
| 3,168 | 7/1843 | Terry | 404/41 |
| 101,346 | 3/1870 | Betteley | 404/41 |
| 107,152 | 9/1870 | Betteley | 404/46 |
| 113,838 | 4/1871 | Beidler | 404/40 |
| 115,457 | 5/1871 | Flanigan | 404/46 |
| 134,492 | 12/1872 | Smith | 404/46 |
| 193,051 | 7/1877 | Stow | 404/46 |
| 220,887 | 10/1879 | Stow | 404/46 X |
| 2,941,456 | 6/1960 | Jacobi | 404/42 |
| 3,905,172 | 9/1975 | Blackburn | 404/46 X |

*Primary Examiner*—Nile C. Byers, Jr.
*Attorney, Agent, or Firm*—Craig and Antonelli

[57] ABSTRACT

A set of paving elements for the production of paving and a method of using the same are disclosed. In a preferred form, the set comprises four cylindrical paving elements of equal height and of different diameter having a diametric proportion to each other of 1:1.4:1.8:2.2. Two or more the of paving elements from each of plurality of sets may be laid to form a paving strip with the paving elements laid next to each other in mutual contact.

8 Claims, 18 Drawing Figures

SET OF PAVING ELEMENTS FOR PRODUCTION OF PAVING AND METHOD OF USING THE SAME

BACKGROUND AND SUMMARY OF THE INVENTION

In this invention there is a set of paving elements for production of paving for paths, open spaces and the like comprising cylindrical paving elements of different diameters. The paving elements are prefabricated and may be formed of cement-concrete and in the preferred embodiment are of equal height.

The proposed set of paving elements is utilized as a paving for rather light loads, especially for walkways and garden paths as well as for open spaces such as courtyards and driveways, and it is primarily suitable for curved paths and for open spaces with irregular boundaries.

A set of structural elements for production of paving for foot paths and walkways is known which consists of two or three cylindrical parts of equal height, which have a specific diametrical relationship to each other (German Gebrauchsmuster No. 7,230,179). With this set of elements, it is possible acceptably to pave regular walks as well as irregular surfaces, by random unordered placing of the three parts, but such a paving places considerable demands on the skill and dexterity of the person laying the pavement. Pavings made with this known set of structural elements are therefore quite expensive.

The invention is intended to improve a set of structures of cylindrical paving elements, in the sense of cost saving management and better adaptability to local conditions.

This problem is solved, in a set of paving elements of the described type, by four elements that are, in one form of the invention, in a diametric proportion to each other of 1:1.4:1.8:2.2. With a set of elements like this, a number of different strip combinations can be laid, as shown. The laying of strip combinations places only slight demands on the skill of the laborer, and it proceeds very rapidly as opposed to random placement, so that considerable savings in cost can be realized without the need to abandon the advantages of cylindrical elements in curved paths and areas with irregular boundaries.

In an advantageous embodiment of the invention, a supplementary paving element is provided whose diameter is 2.6 times that of the smallest paving element. In addition there may be utilization of another supplementary element whose diameter is 3.6 times that of the smallest element. The addition of the four-part set of paving elements, of two supplementary elements, allows construction of other strip combinations which can be fitted without cracks (literally seams) to strips made with the four-part set. Since these supplementary paving elements have a larger diameter, there is more cost saving because with them even fairly large areas can be quickly paved.

Advantageously the diameters of the four paving elements are five, seven, nine and eleven centimeters, the diameter of the first supplementary element is thirteen centimeters and the diameter of the second supplementary element is eighteen centimeters. These diameters yield paving elements that are readily produced, easily shipped, and laid very rapidly.

It has been shown that the problem to which the invention is addressed can also be solved with a set of paving elements for production of pavings for paths, open spaces and the like comprising cylindrical paving elements of different diameters, which comprises four paving elements with diametric proportions of about 1:1.5:1.9:2.3. These prefabricated paving elements may be formed of cement-concrete and in the preferred embodiment are of equal height.

In this set of paving elements, the diameter of the four elements is either 7.0, 10.3, 13.7 and 16.0 centimeters or 6.2, 9.0, 11.6 and 14.1 centimeters, or 5.9, 8.6, 11.0 and 13.4 centimeters.

Advantageously the four paving elements and the two supplementary elements have, on their heads, edges that slope at an angle of 30° with reference to the head, serving as protection against damage in shipment and in laying.

These and other objects, features and advantages of the present invention will become more apparent from the following description when taken in connection with the accompanying drawings, which show, for purposes of illustration only, several embodiments in accordance with the present invention.

DETAILED DESCRIPTION OF THE DRAWINGS

Figure 1:
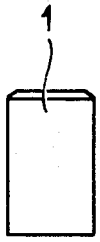
FIGS. 1–4 show four paving elements in a side view.
Figure 2:
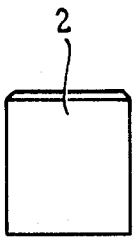
Figure 3:
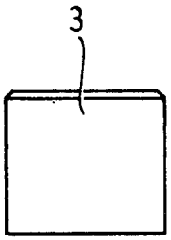
Figure 4:
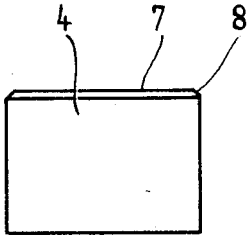
Figure 7:
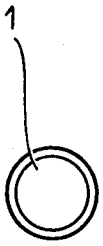
FIGS. 7–10 show the four elements of FIGS. 1–4, in top view.
Figure 8:
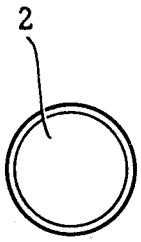
Figure 9:
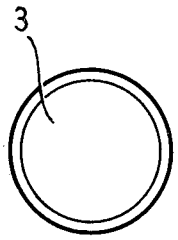
Figure 10:
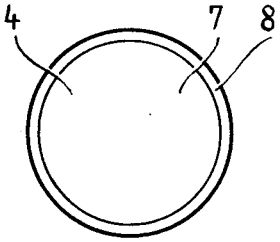
Figure 5:
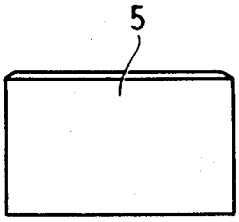
FIG. 5 is a side view of a supplementary paving element.
Figure 6:
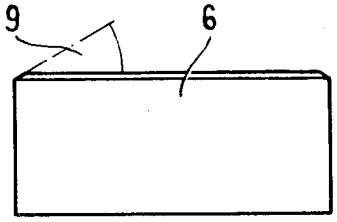
FIG. 6 is a side view of another supplementary paving element.
Figure 11:
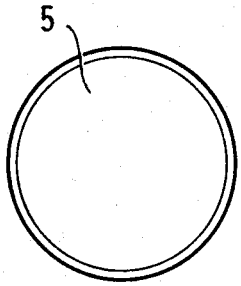
FIG. 11 shows a top view of the supplementary element according to FIG. 5.
Figure 12:
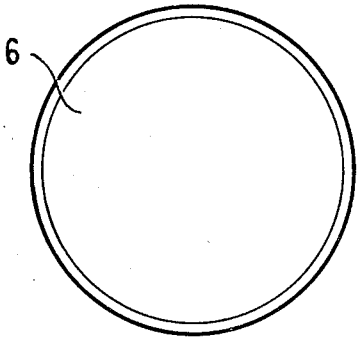
FIG. 12 shows the other supplementary element according to FIG. 6, in top view.

A set of paving elements for production of pavings for paths, open spaces and the like according to the invention comprises four cylindrical cement-concrete elements 1, 2, 3 and 4—see FIGS. 1 to 4 and 7 to 10—and two supplementary elements 5 and 6 (see FIGS. 5 and 6 and 11 and 12, respectively). Elements 1–4 and supplementary elements 5 and 6 are factory-produced: they are of equal height, and their diameters are in proportions to each other of 1:1.4:1.8:2.2:2.6:3.6, i.e. the diameter of paving block 2 of FIG. 2 is 1.4 times larger than that of the block shown in FIG. 1 etc.

Paving elements 1–4 and supplementary elements 5 and 6 are eight centimeters high. The diameter of smallest element 1 is five centimeters and that of the next element 2 is seven centimeters, while the diameters of the two other elements 3 and 4 are nine and eleven centimeters respectively. The two supplementary paving elements 5 and 6 have still larger diameters, namely thirteen and eighteen centimeters respectively.

The heads 7 of paving elements 1–4 and supplementary elements 5 and 6 present sloped edges 8. The said edges 8 are inclined at an angle 9, of 30° with reference to head 7, and all edges 8 are of the same width.

Figure 13:
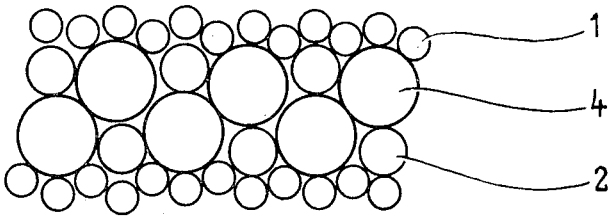
FIG. 13 is a schematic top view of a section of a paving made with the set of paving elements, using those of FIGS. 1, 2 and 4.
Figure 14:
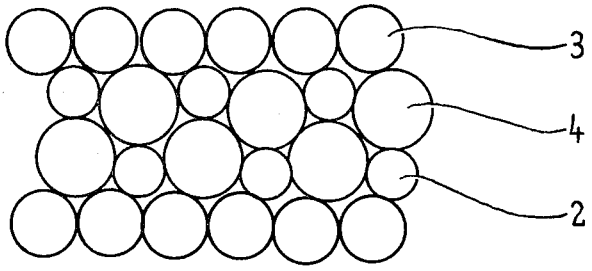
FIG. 14 is a schematic top view of a section of a paving made with elements according to FIGS. 2, 3 and 4.
Figure 15:
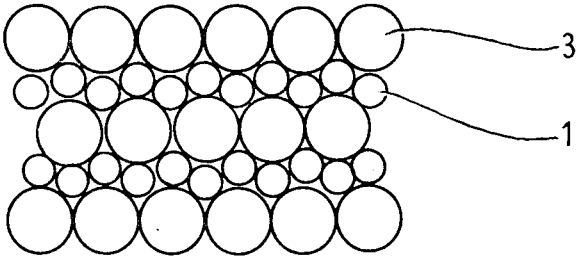
FIG. 15 is a schematic top view of a paving made with paving elements shown in FIGS. 1 and 3.
Figure 16:
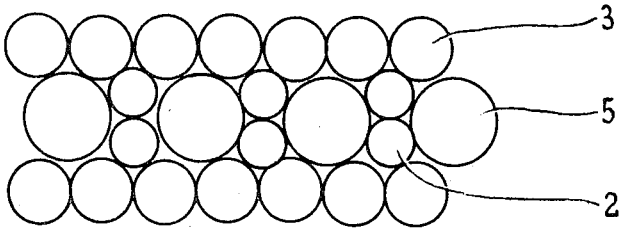
FIG. 16 is a schematic top view of a paving made with elements according to FIGS. 2 and 3, as well as the supplementary element of FIG. 5.
Figure 17:
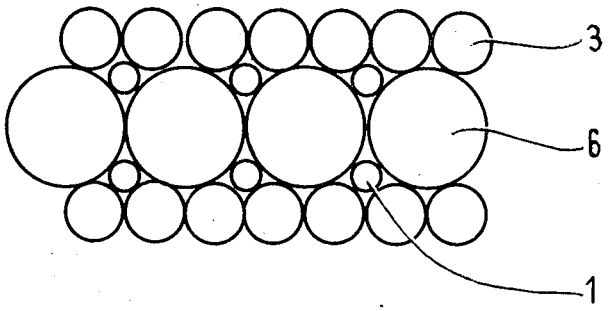
FIG. 17 is a schematic top view of a paving made with paving elements according to FIGS. 1 and 3, as well as the supplementary element of FIG. 6.

In preferred methods of using the sets of paving elements of the invention, paving elements 1 to 4 are put down in different strip combinations, within which the elements are so close together that they are in mutual contact. The first strip combination of this kind is shown in FIG. 13, in which elements 1, 2 and 4 are used. A second combination with use of blocks 2, 3 and 4 are used. A second combination with use of blocks 2, 3 and 4 is shown in FIG. 14, and a third combination with blocks 1 and 3 is illustrated in FIG. 15. Another strip combination with use of paving elements 2 and 3 as well as supplementary element 5 is shown in FIG. 16, and still another combination is shown in FIG. 17 where elements 1 and 3 and supplementary element 6 is used.

Figure 18:
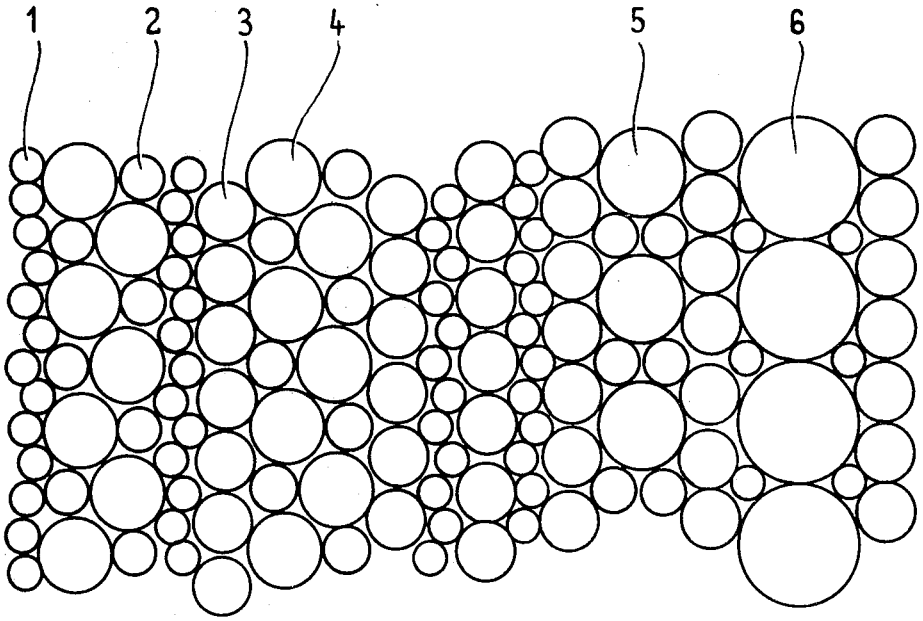
FIG. 18 is a schematic top view of part of a paving made with elements of FIGS. 1–6.

Further, the strip combinations shown in FIGS. 13 to 17 can be combined at random, i.e. they may be laid next to each other so that here also adjacent paving elements are in mutual contact. An example of such a combination is shown in FIG. 18, where all five strip combinations of FIGS. 13 to 17 lie side by side. A paving for a courtyard made in such a way looks random and arbitrary—hence expensive—to the observer, although it is laid according to a precise system (hence in a cost-saving way). With use of the six paving elements, more than thirty different strip combinations can be laid, where between two to six elements are used respectively. Thus the proposed paving elements are usable in a multiplicity of ways and are adaptable to almost all local conditions (especially paving around drains, trees, light poles, etc.), with a minimum of gaps or wedgings.

While we have shown and described only several embodiments in accordance with the present invention, it is understood that the same is not limited thereto but is susceptible of numerous changes and modifications as would be known to those skilled in the art, given the present disclosure, we therefore do not wish to be limited to the details shown and described herein but intend to cover all such changes and modifications as are encompassed by the scope of the appended claims.

I claim:

1. A method of producing paving for paths, open spaces and the like comprising the steps of providing a plurality of sets of paving elements, each set comprising four cylindrical paving elements of different diameter, said four paving elements of each set having a predetermined specific diametric proportion to each other so as to permit a number of different predetermined strip combinations of paving to be laid utilizing said plurality of sets, wherein the paving elements in said strip combinations are so close together that they are in mutual contact, and wherein said predetermined strip combinations can at random be laid next to each other so that adjacent paving elements are in mutual contact thereby producing a paving which looks random and arbitrary although it is laid according to a precise system, and laying at least one of said predetermined strip combinations of paving using paving elements from said plurality of sets of paving elements, and wherein a predetermined strip combination of paving is laid utilizing the smallest, second smallest and largest paving elements of the four cylindrical paving elements in the sets of paving elements; a predetermined strip combination of paving is laid utilizing the second smallest, third smallest and largest paving elements of the four cylindrical paving elements in the sets of paving elements; and a predetermined strip combination of paving is laid utilizing the smallest and third smallest paving elements of the four cylindrical paving elements in the sets of paving elements; the paving elements in each strip of paving being laid in mutual contact and the predetermined strips of paving being laid next to each other so that adjacent paving elements are in mutual contact thereby forming a paving which looks random and arbitrary although it is laid according to a precise system.

2. A method of producing paving according to claim 1, wherein the four paving elements of each set have a predetermined specific diametric proportion to each other of 1:1.5:1.9:2.3.

3. A method of producing paving according to claim 1, wherein each set of paving elements comprises two additional cylindrical paving elements of different diameter, both of which have a diameter larger than that of the largest diameter paving element in the set of four cylindrical paving elements and have a predetermined specific diametric proportion to each other and the other paving elements of the set, and wherein additional predetermined strip combinations of paving are laid utilizing the second smallest, third smallest and next to the largest paving elements of the six cylindrical paving elements in the sets of paving elements and utilizing the smallest, third smallest and largest paving elements of the six cylindrical paving elements in the sets of paving elements.

4. A method of producing paving for paths, open spaces and the like comprising the steps of providing a plurality of sets of paving elements, each set comprising four cylindrical paving elements having a predetermined specific diametric proportion to each other of 1:1.4:1.8:2.2, laying a predetermined strip combination of paving with paving elements having a diametric proportion to each other of 1:1.4:2.2, laying a predetermined strip combination of paving with paving elements having a diametric proportion to each other of 1.4:1.8:2.2, and laying a predetermined strip combination of paving with paving elements having a diametric proportion to each other of 1:1.8, the paving elements in each strip of paving being laid in mutual contact and the predetermined strips of paving being laid next to each other in the paving so that adjacent paving elements are in mutual contact thereby forming a paving which looks random and arbitrary although it is laid according to a precise system.

5. The method according to claim 4, wherein each set of paving elements comprises two additional cylindrical paving elements having respective diametric proportions of 2.6 and 3.6 times larger than the smallest of the recited four cylindrical paving elements, and wherein said method further comprises the step of laying a predetermined strip of paving with paving elements having a diametric proportion to each other of 1.4:2.2:2.6 and laying a predetermined strip of paving with paving elements having a diametric proportion to each other of 1:1.8:3.6, the paving elements in each strip being laid in mutual contact and the predetermined strips being laid next to each other in the paving so that adjacent paving elements are in mutual contact.

6. A paving for paths, open spaces and the like comprising a plurality of predetermined strip combinations formed from paving elements selected from a plurality of sets of paving elements, each set of paving elements comprising four cylindrical paving elements having a predetermined specific diametric proportion to each other of 1:1.4:1.8:2.2, said plurality of predetermined strips including a strip formed from paving elements having a diametric proportion to each other of 1:1.4:2.2, a strip formed from paving elements having a diametric proportion to each other of 1.4:1.8:2.2, and a strip formed from paving elements having a diametric proportion to each other of 1:1.8, the paving elements in each strip being in mutual contact and the predetermined strips being next to each other in the paving so that adjacent paving elements are in mutual contact thereby forming a paving which looks random and arbitrary although it is laid according to a precise system.

7. The paving according to claim 6, wherein each set of paving elements comprises two additional cylindrical paving elements having respective diametric proportions of 2.6 and 3.6 times larger than the smallest of the recited four cylindrical paving elements, and wherein said plurality of predetermined paving strips further includes a strip formed from paving elements having a diametric proportion to each other of 1.4:2.2:2.6, and a strip formed from paving elements having a diametric proportion to each other of 1:1.8:3.6.

8. A paving for paths, open spaces and the like comprising at least one predetermined strip combination of paving formed from paving elements selected from a plurality of sets of paving elements, each set of paving elements comprising four cylindrical paving elements having different diameters with a predetermined specific diametric proportion to each other, the paving elements in said at least one predetermined strip combination of paving being in mutual contact, and wherein a predetermined strip combination of paving is formed from the smallest, second smallest and the largest paving elements of the four cylindrical paving elements in the sets of paving elements, a predetermined strip combination of paving is formed from the second smallest, third smallest and the largest paving elements of the four cylindrical paving elements in the sets of paving elements, and a predetermined strip combination of paving is formed from the smallest and third smallest paving elements of the four cylindrical paving elements in the sets of paving elements, the paving elements in each strip of paving being in mutual contact and the strips of paving being next to each other in the paving so that adjacent paving elements are in mutual contact thereby forming a paving which looks random and arbitrary although it is laid according to a precise system.

* * * * *